United States Patent [19]

Yamazaki et al.

[11] Patent Number: 4,700,104

[45] Date of Patent: Oct. 13, 1987

[54] COLOR TELEVISION SHADOW MASK ASSEMBLY

[75] Inventors: Hidetoshi Yamazaki; Masatsugu Inoue, both of Fukaya, Japan

[73] Assignee: Kabushiki Kaisha Toshiba, Kawasaki, Japan

[21] Appl. No.: 782,443

[22] Filed: Oct. 1, 1985

[30] Foreign Application Priority Data

May 10, 1984 [JP] Japan ..... 59-91793

[51] Int. Cl.[4] ..... H01J 29/07

[52] U.S. Cl. ..... 313/407; 313/402; 313/408

[58] Field of Search ..... 313/404, 407, 402, 408

[56] References Cited

U.S. PATENT DOCUMENTS 3,936,691 2/1976 Bakker et al. ..... 313/407

*Primary Examiner*—David K. Moore
*Assistant Examiner*—K. Wilder
*Attorney, Agent, or Firm*—Cushman, Darby & Cushman

[57] ABSTRACT

A color picture tube comprises a tube envelope having a tube axis and including a neck section, a funnel section and a panel section, an electron gun assembly for emitting at least three electron beams, and a shadow mask assembly disposed in the tube envelope adjacent to the phosphor screen. The shadow mask assembly includes a shadow mask and a frame. The shadow mask has a plate portion which is formed having a curved surface with a dome-like shape opposing the phosphor screen and regularly arranged apertures each for allowing the three electron beams to pass through, and a skirt portion extending from the peripheral portion of the plate portion along the tube axis. The frame surrounds the peripheral portion of the skirt portion of the shadow mask, and the frame and the skirt portion of the shadow mask are coupled to each other by welding at a plurality of locations. The frame is made of a metal material having a thermal expansion coefficient higher than the shadow mask.

1 Claim, 6 Drawing Figures

COLOR TELEVISION SHADOW MASK ASSEMBLY

BACKGROUND OF THE INVENTION

The present invention relates generally to a shadow mask type color picture tube and, more particularly, to the structure of a shadow mask assembly.

In general, a color picture tube of the shadow mask type has a tube envelope which is constituted by a panel section, a funnel section and a neck section. Three electron guns are arranged in the neck section. A color selecting electrode assembly, i.e., the shadow mask assembly, is disposed in the panel section adjacent to a phosphor screen formed on an inner surface of the panel section of the tube envelope. The shadow mask assembly is constituted by a shadow mask having a color selecting function with respect to three electron beams emitted from the electron guns, and a frame for mounting the shadow mask on the panel section at a given distance from its inner surface.

The shadow mask has a plate portion and a skirt portion extending from the plate portion along the tube axis. The plate portion has a central apertured portion with apertures each for allowing electron beams to pass through, and a nonapertured peripheral portion extending toward a peripheral portion of the plate portion. The frame is disposed inside the skirt portion. The skirt portion of the shadow mask is fixed to an outer periphery surface of the frame by spot welding at a plurality of locations. The frame has a holder for fixing the shadow mask to the panel section at the given distance between the shadow mask and the phosphor screen. Low-cost iron is used for the shadow mask and frame.

In the color picture tube of shadow mask type, three electron beams emitted from the electron guns are electromagnetically deflected, and thereafter, land on predetermined phosphors, e.g., red, green and blue phosphors, through an aperture of the shadow mask serving as the color selecting electrode. However, when the color picture tube is operated, the shadow mask itself is thermally expanded by the incident electron beams. For this reason, the relative positional relationship between the center aperture portion of the shadow mask and the phosphor screen is changed. Thus, the location at which the electron beam lands on the phosphor screen varies, and in an extreme case, the color purity of the phosphor screen is considerably degraded.

Generally, deformation of the shadow mask due to thermal expansion when the color picture tube is operated can be classified into two types.

In the first type, the temperature of the whole shadow mask is increased. Thus, the entire shadow mask and the frame are thermally expanded in a direction perpendicular to the tube axis. In the second type, if a particularly bright portion is locally present on the screen when the color picture tube is operated, a portion of the shadow mask corresponding to the bright portion is locally heated. In general, the portion of the shadow mask then thermally expands so as to extend along the tube axis in a so-called dome shape.

In the first type of deformation of the shadow mask, as disclosed in Japanese Patent Disclosure No. 44-3547, a bimetal member is interposed between the frame and the holder. The shadow mask assembly can be automatically compensated for by means of the bimetal member so as to approach to the phosphor screen formed on the inner surface of the panel portion in accordance with the increase in temperature of the entire shadow mask.

Meanwhile, as for the second type of deformation, since the thermal expansion occurs locally when the color picture tube is operated, no effective compensation method has yet been found as in the bimetal member mentioned in the first type of deformation, but various proposals have been made.

In one proposal, as disclosed in Japanese Patent Disclosure Nos. 42-25446, 50-58977 and 50-68650, a material having a low thermal expansion coefficient, e.g., an invar alloy is used for the shadow mask assembly. However, such a metal having a low thermal expansion coefficient, e.g., invar alloy is expensive compared to iron. Therefore, the use of such a metal not only for the shadow mask but also for the frame results in a considerable increase in cost. Therefore, it is preferable that the metal having low thermal expansion coefficient be used only for the shadow mask which is relatively light in weight, and a low-priced iron material be used for the frame which is relatively heavy. Because the volume of the frame is much larger than that of the shadow mask.

However, if different metals are used for the shadow mask and the frame, when the temperature of the overall shadow mask assembly becomes high, e.g., when the color picture tube is manufactured, the shadow mask is deformed due to the difference in thermal expansion coefficients. That is, as shown in FIG. 1, when the temperature of an overall shadow mask assembly 2 becomes high, a frame 4 made of an iron material having a high thermal expansion coefficient is greatly expanded, so that the outer periphery surface of the frame 4 pushes the inner periphery surface of a shadow mask 8, as indicated by arrows 6. On the other hand, since the shadow mask 8 is made of a material having a low thermal expansion coefficient, the shadow mask 8 itself is deformed very little. Thus, as indicated by imaginary lines 12 in FIG. 2, the shadow mask 8 is plastically deformed by tension from the entire outer periphery surface of the frame at its surrounding portion, i.e., at the periphery of its nonapertured and apertured portions along the tube axis in a direction away from the phosphor screen. Plastic deformation at the apertured portion degrades color purity on the phosphor screen. Degradation in color purity on the screen occurs in a frame shape having a constant width, and is called a "frame effect".

In the above proposal, since the frame is formed smaller in size than a space defined by the inner side surfaces of the skirt portion of the shadow mask, a portion of the frame is disposed inside the skirt portion of the shadow mask. In contrast, in Japanese Patent Disclosure No. 52-79770 and Japanese Patent Disclosure No. 55-130045 as a divisional application thereof, the frame is formed larger than a space defined by the outer side surfaces of the skirt portion of the shadow mask, and a portion of the frame surrounds the skirt portion. However, in this case, the shadow mask and the frame are made of the same material, and no solution for plastic deformation of the shadow mask when different materials are used is disclosed.

SUMMARY OF THE INVENTION

It is an object of the present invention to provide a color picture tube comprising a shadow mask assembly which is free from the above drawbacks and uses different metals for the shadow mask and the frame so as to control local thermal expansion of the shadow mask when the color picture tube is operated and to prevent plastic deformation even in a high temperature state even if the color picture tube is manufactured.

According to the present invention, a color picture tube comprises a tube envelope having a tube axis and including a neck section, a funnel section and a panel section having a phosphor screen on an inner surface thereof, an electron gun assembly for emitting at least three electron beams, and a shadow mask assembly disposed in the tube envelope adjacent to the phosphor screen. The shadow mask assembly includes a shadow mask and a frame. The shadow mask has a plate portion which is formed to have a dome-like curved surface opposing the phosphor screen and regularly arranged apertures each for selectively allowing the three electron beams emitted from the electron gun assembly to pass through, and a skirt portion extending from a peripheral portion of the plate portion along the tube axis. The frame surrounds a peripheral portion of the skirt portion of the shadow mask, and the frame and the skirt portion of the shadow mask are coupled to each other by welding at a plurality of locations. In addition, the frame is made of a metal material having a thermal expansion coefficient higher than the shadow mask.

With the above structure, particularly, the structure of the shadow mask assembly, when the color picture tube is operated, local thermal expansion of the shadow mask can be controlled, and even in a high temperature state when the color picture tube is manufactured, plastic deformation of the shadow mask does not occur.

In a preferred embodiment of the present invention, the frame is made of an iron material, and the shadow mask is made of an invar alloy. Assuming that the distance along the tube axis between a welded portion coupling the skirt portion of the shadow mask and the frame, and an edge portion of the skirt portion coupled to the plate portion of the shadow mask is given by d mm, and a nominal dimension of the phoshor screen, i.e., the length of a diagonal of the phosphor screen is given by S mm, d and S substantially satisfy the following relation:

$$d > 0.02 \times S$$

With the above structure, a metal material having a low thermal expansion coefficient can be used for the shadow mask in the shadow mask assembly, and local thermal deformation of the shadow mask can be prevented without increasing the cost when the color picture tube is operated.

DETAILED DESCRIPTION OF THE PREFERRED EMBODIMENTS

A color picture tube according to an embodiment of the present invention will be described with reference to FIGS. 3 to 6.

Figure 1:
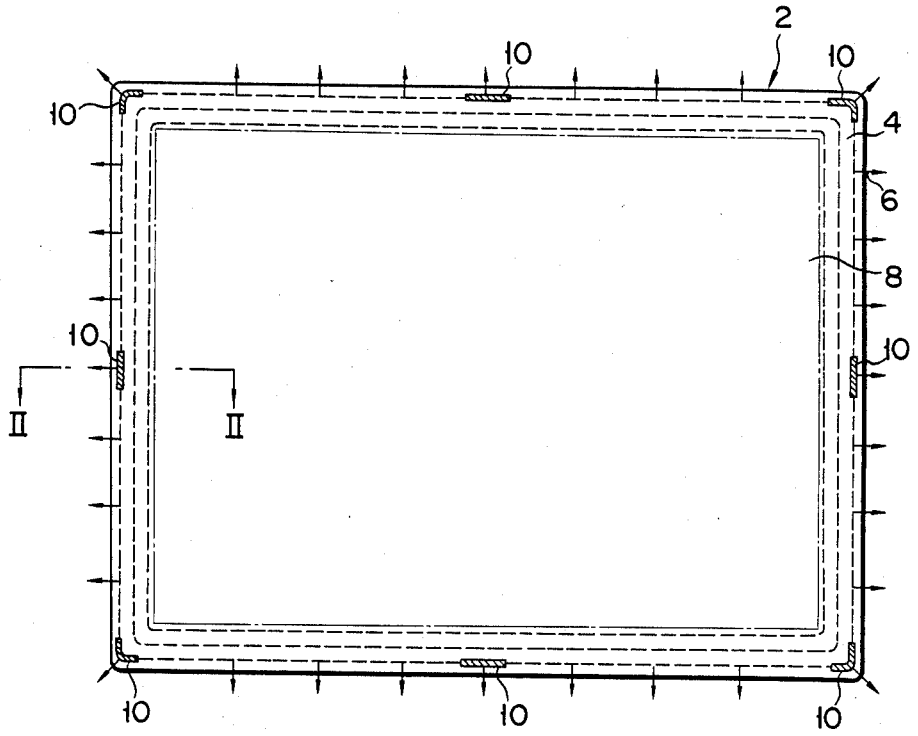
FIG. 1 (PRIOR ART)
FIG. 1 is a plan view showing a conventional shadow mask assembly in which tension from thermal expansion is indicated by arrows.
Figure 2:
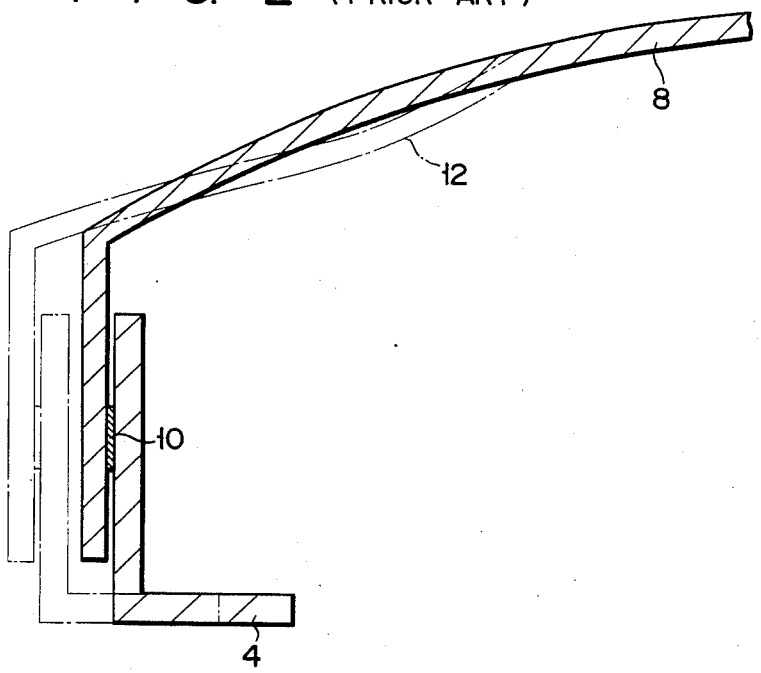
FIG. 2 (PRIOR ART)
FIG. 2 is an enlarged sectional view showing the conventional shadow mask assembly cut away along the line II—II, in which deformation of the shadow mask assembly in a high temperature state when the color picture tube is manufactured is indicated by imaginary lines.
Figure 3:
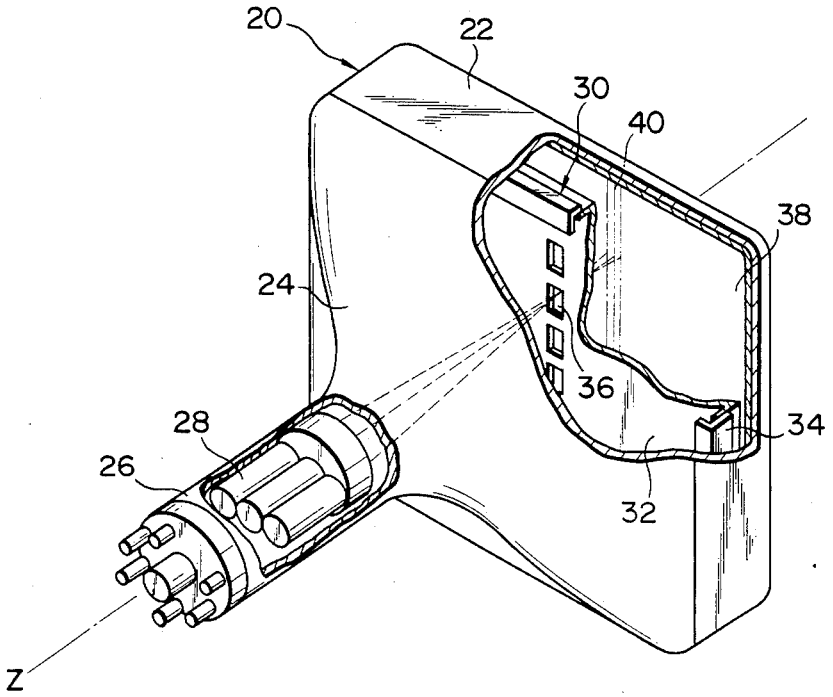
FIG. 3 is a partially cutaway perspective view schematically showing a color picture tube according to an embodiment of the present invention.

FIG. 3 schematically shows a shadow mask type color picture tube. The color picture tube has a tube envelope 20 which is constituted by a panel section 22, a funnel section 24 and a neck section 26. Three inline electron guns 28 for emitting red, green and blue electron beams are arranged in the neck section 26.

A shadow mask assembly 30 is disposed in the panel section 22 of the tube envelope 20 as a color selecting electrode assembly. The shadow mask assembly 30 includes a shadow mask 32 and a frame 34. The shadow mask 32 has apertures 36 each for selectively allowing three electron beams emitted from the electron guns to pass through. A phosphor screen 38 is formed on an inner surface of the panel section 22 of the tube envelope 20 opposite to the shadow mask 32. The phosphor screen 38 has red, green and blue phosphor layers 40 corresponding to the three electron beams.

Figure 4:
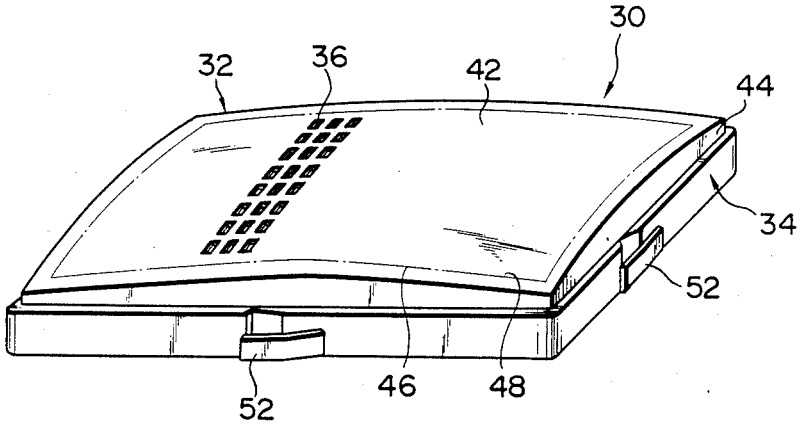
FIG. 4 is a perspective view showing a shadow mask assembly in FIG. 3.
Figure 5:
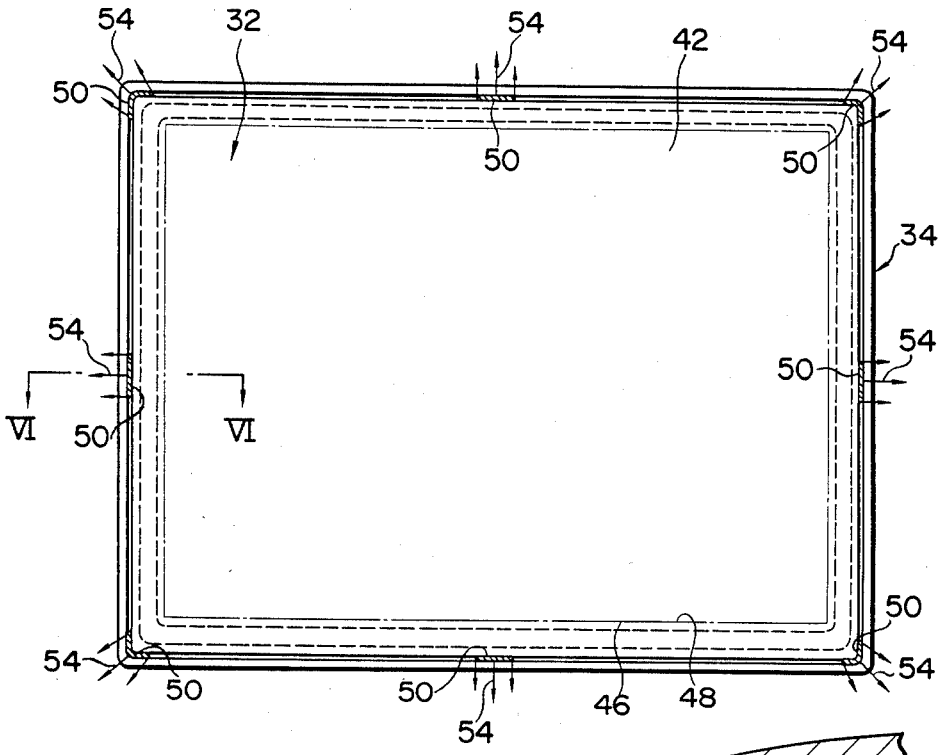
FIG. 5 is a schematic plan view of the shadow mask assembly in FIG. 3, in which tension in a frame from thermal expansion is indicated by arrows.

FIGS. 4 and 5 show the shadow mask assembly 30 of the present invention in detail. The shadow mask 32 has a plate portion 42 and a skirt portion 44 extending from the plate portion 42 along the tube axis. The plate portion 42 has a central apertured portion 46 in which apertures 36 are regularly formed along the horizontal direction parallel to the in-line direction and along the vertical direction, and a nonapertured peripheral portion 48 extending toward a peripheral portion of the portion 42 from the central apertured portion 46. On the other hand, the frame 34 has an L-shaped cross section along the tube axis. An inner surface of the frame 34 surrounds part of the skirt portion 44 of the shadow mask 32. That is, the frame 34 surrounding the skirt portion 44 is formed to be slightly larger in size than the skirt portion 44 of the shadow mask 32. They may be substantially equal to each other, through. As shown in FIG. 5, the inner surface of the frame 34 is fixed to the skirt portion 44 of the shadow mask 32 by spot welding. A total of eight welded portions 50 (i.e., four at the corners and four in the centers of side surfaces of the frame 34) are formed between the inner surface of the frame 34 and the skirt portion 44 of the shadow mask 32. Referring again to FIG. 4, a holder 52 is fixed to the outer surface of the frame 34. The shadow mask 32 is fixed to the skirt portion of the panel section 22 spaced apart by a predetermined distance from the phosphor screen 38 formed on the inner surface of the panel section 22.

The shadow mask 32 is made of a material having a low thermal expansion coefficient such as an invar alloy containing 36% of nickel. On the other hand, the frame 34 is made of a low-priced iron material.

When the color picture tube described above is operated, three electron beams emitted from the electron guns are electromagnetically deflected, and thereafter, land on predetermined phosphors, i.e., R, G and B phosphors, through the predetermined aperture 36 of the shadow mask 32 serving as the color selecting electrode. The area of the apertures 36 in the shadow mask 32 is 15 to 20% that of the central apertured portion 46. Almost all electron beams emitted from the electron guns excluding those passing through the apertures 36 of the shadow mask 32 impinge on the shadow mask 32. As a result, the shadow mask 32 itself is heated. For example, when a 21 inch color picture tube is operated at an anode voltage of 25 kV and an anode current of 1,200 A, the central apertured portion 46 of the shadow mask 32 is heated to 70° C.

Deformation of the shadow mask 32 serving a color selecting electrode when the color picture tube is operated will be described with reference to FIGS. 5 and 6.

When the overall shadow mask assembly 30 is heated, the frame 34 made of the iron material is thermally expanded more than the shadow mask 32 made of the invar alloy. As indicated by arrows in FIG. 5, the expanded frame 34 pulles the inner surface of the shadow mask 32 through the welded portions 50 between the shadow mask 32 and the frame 34. However, as shown in FIG. 5, the tension 54 thus occurs to the shadow mask 32 is limited to a plurality of portions, i.e., to the welded portions 50, but is not applied to the overall inner surface of the shadow mask 32. As indicated by imaginary lines 56 in FIG. 6, deformation of the shadow mask 32 is limited to its skirt portion 44. Since the tension 54 is very weak compared to the conventional shadow mask assembly in which the frame is arranged inside the skirt portion, if the temperature of the overall assembly 30 is returned to a normal temperature, the skirt portion 44 of the shadow mask 32 can be substantially returned to the original shape. Therefore, the central apertured portion 46 of the shadow mask 32 will not be deformed.

Even when the overall assembly 30 is subjected to high temperature (e.g., 400° C.) when the color picture tube is manufactured, the central apertured portion 46 of the shadow mask 32 will not be deformed in the same manner as when the color picture tube is operated.

Figure 6:
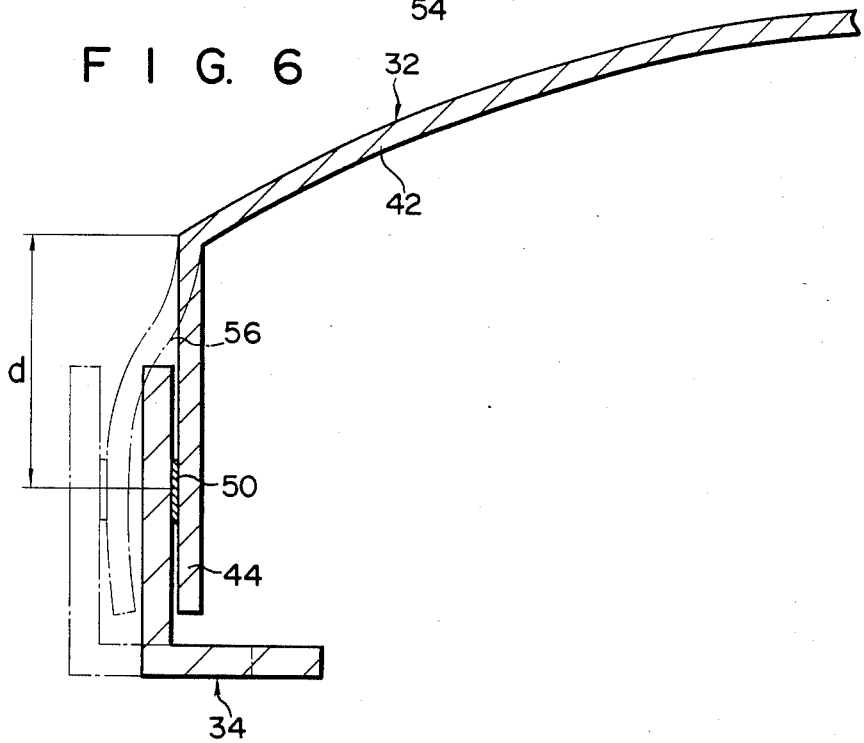
FIG. 6 is an enlarged sectional view showing the shadow mask assembly of FIG. 5 cut away along the line VI—VI, in which deformation of the shadow mask assembly in a high temperature state when the color picture tube is manufactured is indicated by imaginary lines.

In this case, as shown in FIG. 6, when a distance of between an upper end of the skirt portion 44 of the shadow mask 32 and the welded portion 50 becomes short, the tension 54 due to thermal expansion of the frame 34 at high temperature cannot be absorbed by only the skirt portion 44 of the shadow mask 32. For this reason, the tension 54 is applied to the nonapertured peripheral portion 48 and the central apertured portion 46 of the shadow mask 32, resulting in plastic deformation of the shadow mask 32.

The present inventors experimentally examined a deformation absorption amount in the skirt portion 44 of the shadow mask 32 using envelope tubes of various sizes. As a result, in order to absorb the tension in the frame 34 due to thermal expansion by the skirt portion 44 of the shadow mask 32, the following inequality must be satisfied:

$$d > 0.5 \times s \quad (1)$$

where d is the distance between the upper end of the skirt portion 44 of the shadow mask 32 and the welded portion 50 (unit: mm), and s indicates the nominal dimension of the phosphor screen 38, i.e., the length of the diagonal thereof (unit: inch).

When units are equalized in inequality (1), it can be rewritten as follows:

$$d > (1/25.4) \times 0.5 \times S \approx 0.02 \times S \quad (2)$$

where S is the nominal dimension of the phosphor screen 38 in the same manner as "s", but the unit is mm.

As long as the shadow mask assembly 30 satisfies inequality (1) or (2), when the temperature of the overall assembly 30 is returned to a normal temperature, the skirt portion 44 of the shadow mask 32 can be returned to the original shape. Therefore, the central apertured portion 46 of the shadow mask 36 will not deform. Thus, the so-called "frame effect" of the phosphor screen 38 can be prevented.

What is claimed is:

1. A color picture tube comprising:

a tube envelope having a tube axis and including a neck section, funnel section and a panel section having a phosphor screen on an inner surface thereof;

an electron gun assembly, disposed in said neck section of said tube envelope, for generating at least three electron beams; and a shadow mask assembly disposed in said tube enevelope to be adjacent to said phosphor screen, said shadow mask assembly including, a shadow mask having a plate portion which is formed to have a dome-shaped curved surface opposing said phosphor screen, and regularly aligned apertures each for selectively allowing the three electron beams emitted from said electron gun assembly to pass through, and a skirt portion extending from a periphery of said plate portion along the tube axis, and a frame entirely surrounding a peripheral portion of said skirt portion of said shadow mask, said frame being coupled to said skirt portion of said shadow mask by welding at a plurality of locations and said frame being made of an iron material having a thermal expansion coefficient higher than that of said shadow mask, said shadow mask being made from a low thermal expansion coefficient iron alloy containing approximately 36% nickel, and wherein the dimension, $d^{mm}$, along the tube axis between a welded portion for coupling said skirt portion of said shadow mask and said frame, and an edge portion of said skirt portion adjacent said plate portion, is governed by the relationship $d^{mm} > 0.02 \times S_{mm}$ where $S_{mm}$ is the diagonal dimension of said phosphor screen.

* * * * *

UNITED STATES PATENT AND TRADEMARK OFFICE

CERTIFICATE OF CORRECTION

PATENT NO. : 4,700,104

DATED : October 13, 1987

INVENTOR(S) : Hidetoshi YAMAZAKI and Masatsugu INOUE

It is certified that error appears in the above-identified patent and that said Letters Patent is hereby corrected as shown below: On the title page Please delete the following in above-identified patent:

[30] Foreign Application Priority Data

May 10, 1984 [JP] Japan .....59-91793

Signed and Sealed this

Tenth Day of May, 1988

*Attest:*

*Attesting Officer*

DONALD J. QUIGG

*Commissioner of Patents and Trademarks*